US005430629A

United States Patent [19]

Belliveau et al.

[11] Patent Number: 5,430,629

[45] Date of Patent: Jul. 4, 1995

[54] FLUID-FILLED COLORED LIGHT PATTERN GENERATOR

[75] Inventors: Richard S. Belliveau; Steven T. Mahanay, both of Austin, Tex.

[73] Assignee: High End Systems, Inc., Austin, Tex.

[21] Appl. No.: 277,648

[22] Filed: Jul. 20, 1994

[51] Int. Cl.[6] ..... F21V 9/00

[52] U.S. Cl. ..... 362/293; 362/318; 362/806; 362/811

[58] Field of Search ..... 362/318, 293, 811, 101, 362/96, 806

[56] References Cited

U.S. PATENT DOCUMENTS

| | | | |
|---|---|---|---|
| 1,152,676 | 9/1915 | Walsh | 362/318 |
| 1,203,464 | 8/1920 | Dawe . | |
| 1,246,566 | 9/1921 | Doody . | |
| 1,536,328 | 12/1928 | Doody . | |
| 2,063,296 | 12/1936 | Braune | 362/318 |
| 4,170,035 | 10/1979 | Walker | 362/318 X |
| 4,388,678 | 6/1983 | Turner | 362/318 X |
| 4,742,439 | 5/1988 | Choate | 362/811 X |
| 4,858,083 | 8/1989 | Wakimoto | 362/811 |
| 4,942,504 | 7/1990 | Brotz | 362/811 X |

*Primary Examiner*—Ira S. Lazarus
*Assistant Examiner*—Thomas M. Sember
*Attorney, Agent, or Firm*—James R. Bell

[57] ABSTRACT

A fluid-filled, colored light pattern generator including a pair of transparent plates maintained in spaced relationship by a spacer ring. The ring includes an orifice for admitting fluid into a sealed cavity formed by the plates and the ring. Colored image producing members are suspended for random floatation in the fluid so that when a beam of light is passed through the plates, moving colored images are projected.

16 Claims, 2 Drawing Sheets

FIG. 1
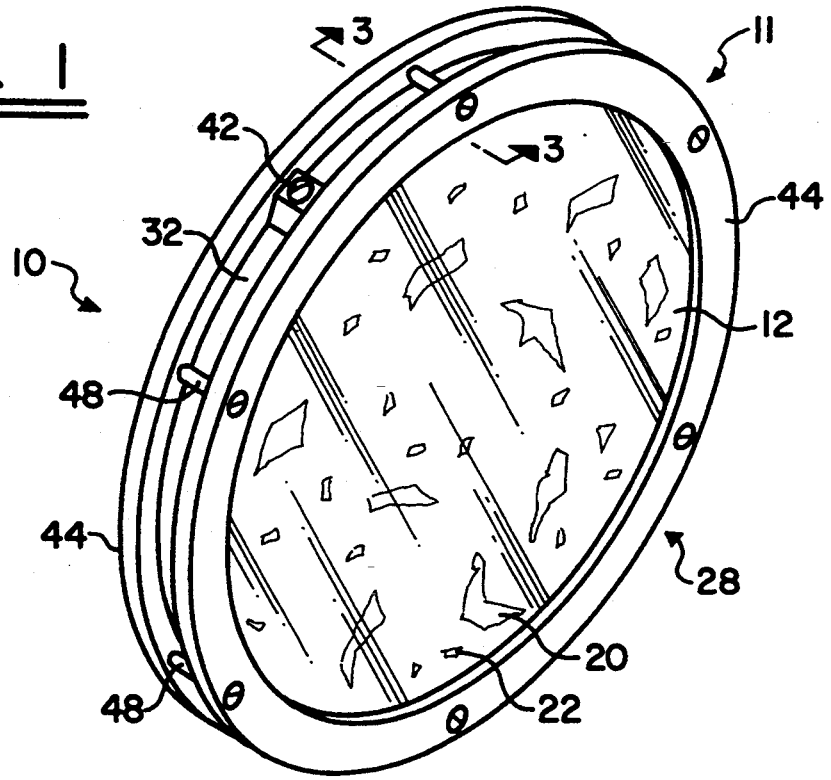
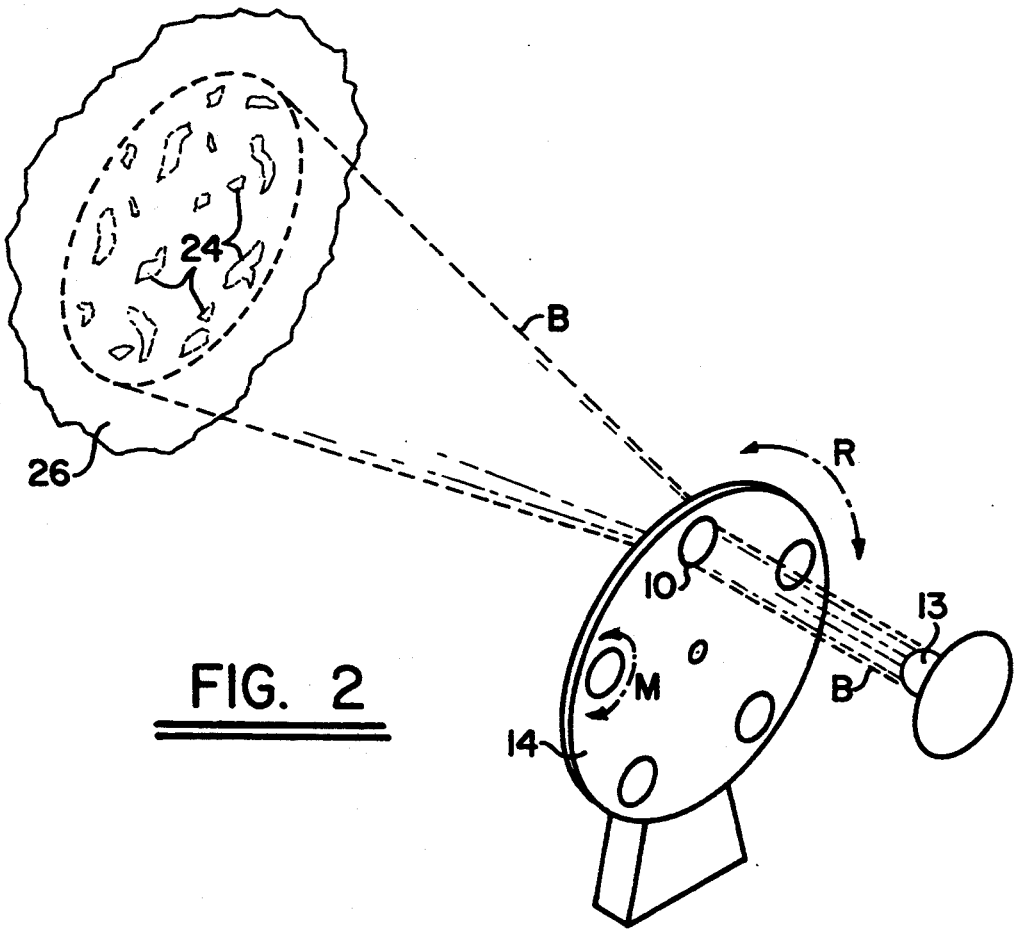
FIG. 2

FLUID-FILLED COLORED LIGHT PATTERN GENERATOR

FIELD OF THE INVENTION

This invention relates generally to stage and theater lighting and specifically to projecting light produced images by passing a beam of light through a fluid filled colored light pattern generator or gobo including a cavity having colored image producing members suspended in the fluid.

BACKGROUND OF THE INVENTION

One commonly used gobo comprises a sheet of metal having a desired image cut out of the sheet. When the sheet is placed in a beam of light, the portion of the beam that passes through the sheet is shaped to correspond to the image.

Another commonly used gobo for creating artistic lighting effects comprises a metal coated glass disc with a portion of the coating etched in the shape of an image. When the disc is placed in a beam of light, the portion of the beam that passes through the disc is shaped to correspond to the image.

In the past, oils of various colors and viscosities were also used to create artistic colored lighting effects when a beam of light was passed through a plate or disc which contained the oil. For example, it is known that some hot oil projection was accomplished through the combination of an overhead projector and oils of various colors and viscosities contained in a transparent plate which when moved, caused the moving colored oils to translate to projected moving color patterns.

Also, it is known that a transparent disc having a plurality of segregated cavities therein, which contained various colored oils, was inserted into the path of a light beam and rotated to create animated, artistic colored lighting effects.

A major consideration of using such oils is that the oils must not be overheated by the light beam. Today's lights are of high watt density and high energy. Therefore, the oil selected must be low absorbing with regard to the energy passed though it, i.e. it must have a high operating temperature, so that it can survive with a high amount of energy passing through it via the light beam.

The foregoing illustrates limitations of the known prior art. Thus, it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing a colored light pattern generator comprising a pair of transparent plates maintained in spaced relationship by a peripheral retainer, whereby the plates and retainer define a cavity. A seal member is retained between the plates and the retainer. Means are provided in the cavity for producing projected images in response to a beam of light being passed through the plates. Means are also provided for permitting fluid to be introduced into the cavity, whereby the means for producing images become suspended in random floatation in the cavity.

In another aspect of the present invention, this is accomplished by a colored light pattern generator comprising a spacer ring and a pair of transparent plates maintained in spaced relationship by being engaged with opposite sides of the spacer ring, whereby the plates and spacer ring define a cavity. A pair of clamping rings are provided so that one clamping ring in engaged with one plate on one side of the spacer ring and the other clamping ring is engaged with the other plate on the opposed side of the spacer ring. Means are provided to interconnect the clamping rings for retaining the plates in engagement with the spacer ring. Further means are provided for sealing the plates an spacer ring for retaining fluid in the cavity.

In a further aspect of the present invention, this is accomplished by a colored light pattern generator including a pair of transparent plates maintained in spaced relationship by a spacing ring, including a radially extending, fluid admitting orifice formed therein. The spacer ring and the plates define a fluid retaining cavity. Means are provided for maintaining the plates and the spacer ring in fluid sealing engagement.

In a still further aspect of the present invention, this is accomplished by a colored image projection system comprising a container having transparent walls, movably mounted in the path of a light beam. The container defines a fluid cavity therein which contains an optically clear fluid and a plurality of various color producing shaped solid particles suspended for random movement in the fluid, so that when the light beam is passed through the container, and the container is moved, various moving colored images are projected by the beam due to the particles interfering with passage of the beam through the container.

The foregoing and other aspects will become apparent from the following detailed description of the invention when considered in conjunction with the accompanying drawing figures. It is to be expressly understood, however, that the figures are not intended as a definition of the invention, but are for the purpose of illustration only.

BRIEF DESCRIPTION OF THE DRAWING FIGURES

FIG. 1 is a perspective view illustrating an embodiment of the gobo of the present invention;

FIG. 2 is a schematic view illustrating a gobo movably mounted in a projected light path;

DETAILED DESCRIPTION OF THE INVENTION

Figure 3:
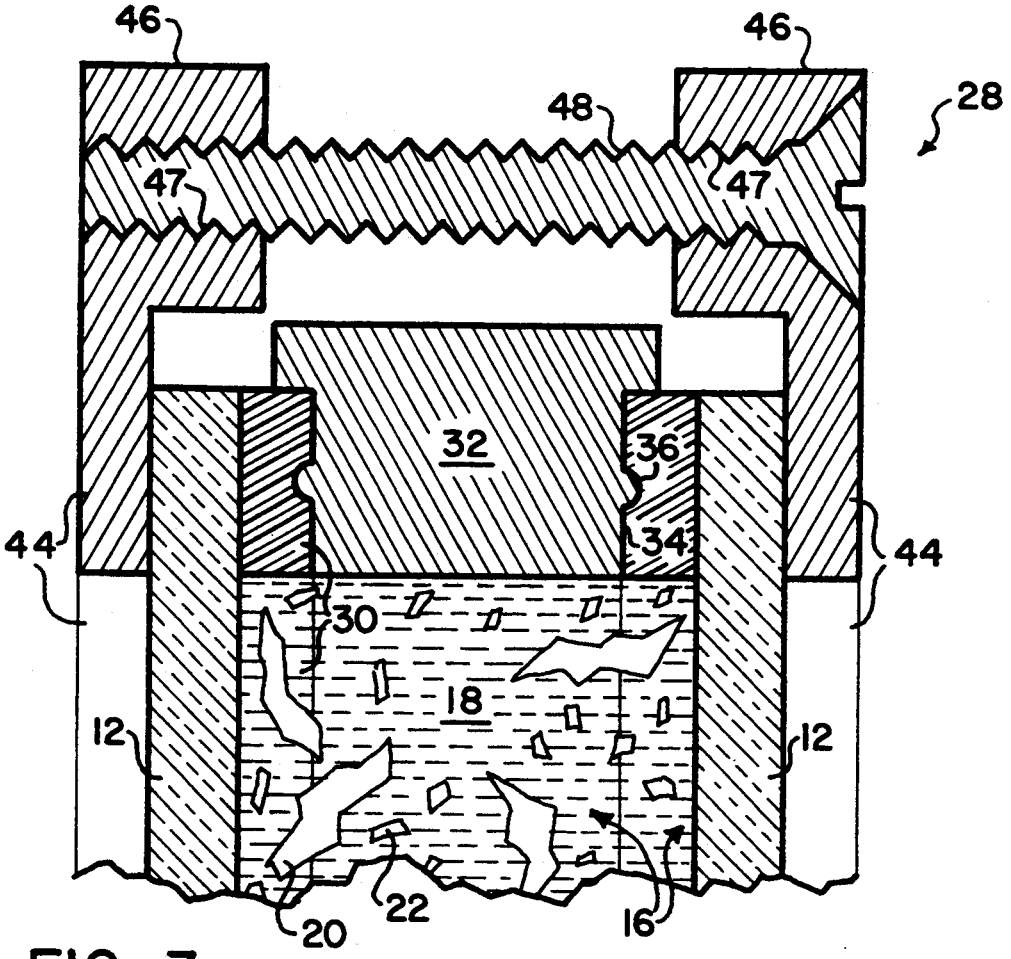
FIG. 3 is an enlarged partial cross-sectional view taken along the line 3—3 on FIG. 1.

In stage and theater lighting, it is well known to mount a gobo in a movable gobo holder so that when a light beam is passed through the gobo, an image is projected on a projection surface.

FIGS. 1–4 illustrate that a gobo 10 comprises a container 11 having transparent plates or walls 12. Gobo 10 may be movably mounted in a gobo wheel 14, which bi-directionally rotates as indicated by the arrow designated R, so that when gobo 10 is moved into the path of a light beam designated B, generated from a light source 13, the selected gobo image is in position to be projected by the light. Present gobos 10 also bi-directionally rotate as indicted by the arrow designated M, independent of the wheel 14 once the gobo 10 is positioned in the beam B. A fluid cavity 16 is defined within the container 11. An optically clear fluid 18, preferably 510 silicone fluid manufactured by Dow Corning, is in the cavity 16 and a plurality of various color producing shaped solid translucent particles 20, 22 are suspended for random movement in fluid 18. Particles 20, 22 are preferably dichroic filters. Thus, when the beam B is passed through transparent plates 12 of container 11, various moving color producing images 24 are projected by the beam B onto a projection surface 26, which may be a solid surface or theatrical fog, in response to the particles 20, 22 interfering with, but not blocking passage of the beam B through container 11.

Figure 4:
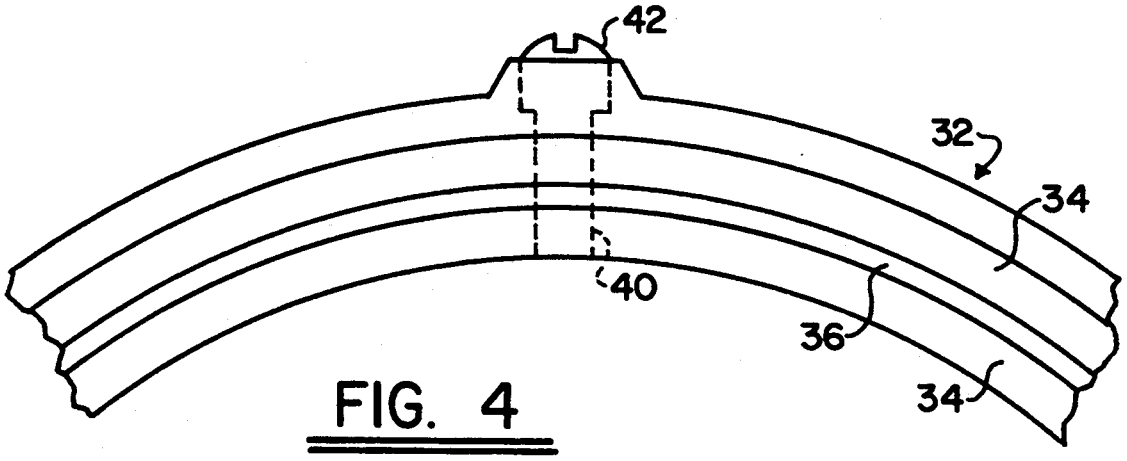
FIG. 4 is an enlarged partial side elevational view of an embodiment of the spacer ring of the present invention.

FIGS. 3–4 illustrate features of gobo 10 more particularly. Generally, gobo 10 comprises a pair of transparent circular plates 12, preferably formed of quartz, which are maintained in spaced relationship by an annular peripheral retainer generally designated 28. Plates 12 and retainer 28 define cavity 16. An O-ring seal member 30, preferably formed of a material sold under the name Fluorosilicone by the Stockwell Rubber Company of Philadelphia, Pa., is retained in sealing engagement as will be described below.

The particles 20 are preferably particles of dichroic coated glass 20 which are heated in a kiln to a temperature which causes the glass to begin to flow, thus smoothing the sharp edges and distorting the shape somewhat, and particles 22 which are dichroic metal flakes which have been separated from the glass substrate on which they are deposited. When light is passed through the gobo 10, particles 20, 22 distort the light beam and filter out some colors of the spectrum to create desired colored lighting effects. Distortion of the shape of the glass 20 by heating, also distorts the color image produced by the glass because of the use of a dichroic coating, especially at the edges thereof.

Retainer 28 is preferably formed of aluminum and comprises a spacer ring 32 including opposed seats 34 having an annular raised nub 36 formed thereon. Spacer ring 32 also includes a radially extending orifice 40 formed therethrough so that fluid 18 can be introduced into cavity 16. A plug 42 is threaded into orifice 40 for retaining fluid 18 in cavity 16. Preferably, plug 42 is coated with a silicone gel and then threadedly inserted into orifice 40 to enhance sealing.

Also included in retainer 28 are a pair of opposed clamping rings 44 including a ranged outer annular periphery at 46 provided with a plurality of threaded, opposed apertures 47 for receiving threaded fasteners 48, preferably of stainless steel.

In accordance with the structural features of the present invention, cavity 16 is defined by plates 12 and retainer 28. Seal members 30 are sandwiched between seats 34 and plates 12. Annular nubs 36 enhance the sealing engagement of sealing O-rings 30 in seats 34. When clamping rings 44 are interconnected by threaded fasteners 48, plates 12 urge seals 30 into sealing engagement with seats 34 including nubs 36.

Prior to closing of cavity 16, the particles 20, 22 are deposited therein. After gobo 10 is assembled, fluid 18 is injected into cavity 16 via orifice 40 using a syringe. Plug 42, including the previously mentioned silicone gel coating, is threaded into orifice 40 to enhance sealing.

Gobo 10 can then be placed in a gobo wheel 14 and positioned in light beam B, then rotated in position to provide the desired artistic lighting effect created by the random suspension of particles 20, 22 in fluid 18 within cavity 16.

While this invention has been illustrated and described in accordance with a preferred embodiment, it is recognized that variations and changes may be made therein without departing from the invention as set forth in the claims.

Having described the invention, what is claimed is:

1. A colored light pattern generator comprising:

a pair of transparent plates maintained in spaced relationship by a peripheral retainer, whereby the plates and retainer define a cavity;

a seal member retained between the plates and the retainer; and means in the cavity for producing projected colored images in response to a beam of light being passed through the transparent plates, the means for producing colored images including a fluid and pieces of dichroic glass suspended in random floatation in the fluid, the pieces having been formed by heating the glass to a temperature sufficient to cause the glass to flow, thus smoothing the edges and distorting the shape thereof, whereby the color of the images is also distorted.

2. The colored light pattern generator as defined is claim 1 wherein the plates are circular glass plates.

3. The colored light pattern generator as defined in claim 2 wherein the retainer comprises a spacer ring and a pair of clamping rings, the plates being engaged with opposite sides of the spacer ring and the clamping rings being interconnected to retain the plates in sealing engagement with the spacer ring.

4. The colored light pattern generator as defined in claim 2 wherein the opposite sides of the spacer ring include seating means for receiving the seal member and plates.

5. A colored light pattern generator comprising:

a spacer ring;

a pair of transparent plates maintained in spaced relationship by being engaged with opposite sides of the spacer ring, whereby the plates and spacer ring define a cavity;

a pair of clamping rings, one clamping ring engaged with one plate on one side of the spacer ring, and the other clamping ring engaged with the other plate on the opposed side of the spacer ring;

means interconnecting the clamping rings for retaining the plates in engagement with the spacer ring;

means for sealing the plates and spacer ring for retaining fluid in the cavity; and means in the cavity for producing projected, floating colored images in response to a beam of light being passed through the transparent plates, the means for producing the images including a clear fluid and pieces of dichroic glass suspended in random floatation in the fluid, the pieces having been formed by heating the glass to a temperature sufficient to cause the glass to flow, thus smoothing the edges and distorting the shape thereof, whereby the color of the images is also distorted.

6. The colored light pattern generator as defined in claim 5 wherein the spacer ring includes a radially extending orifice.

7. The colored light pattern generator as defined in claim 6 wherein the plates are circular glass plates.

8. The colored light pattern generator as defined in claim 7 wherein the opposite sides of the spacer ring include seating means for receiving the sealing means and the plates.

9. A colored light pattern generator including a pair of transparent plates maintained in spaced relationship by a spacer ring, the ring including a radially extending, fluid admitting orifice formed therein, the spacer ring and the plates defining a fluid retaining cavity, means for maintaining the plates and the spacer ring in fluid sealing engagement, and means in the cavity for producing projected, colored images in response to a beam of light being passed through the transparent plates, the means for producing projected, colored images including pieces of dichroic glass which have been formed by heating the glass to a temperature sufficient to cause the glass to flow, thus smoothing the edges and distorting the shape thereof, whereby the color of the images is also distorted, and in response to fluid being introduced into a the cavity through the orifice, the pieces of dichroic glass become suspended in random flotation in the cavity.

10. The colored light pattern generator as defined in claim 9 wherein the means for producing projected, colored images also include dichroic flakes.

11. A colored light pattern generation image projection system comprising:

a container having transparent walls, movably mounted in the path of a light beam, the container defining a fluid cavity therein, an optically clear fluid in the cavity and a plurality of various color producing, shaped solid translucent particles suspended for random movement in the fluid, the particles including pieces of dichroic glass which have been formed by heating the glass to a temperature sufficient to cause the glass to flow, thus smoothing the edges and distorting the shape thereof, whereby the color of the images is also distorted, and whereby when the light beam is passed through the container, and the container is moved, various moving colored images are projected by the beam onto a projection surface in response to the particles interfering with passage of the beam through the container.

12. The system as defined in claim 11 wherein the transparent walls are of glass.

13. The system as defined in claim 12, and further including:

a spacer ring separating the walls.

14. The system as defined in claim 13, and further including:

seal means sealingly engaged between the spacer ring and the walls.

15. The system as defined in claim 14, and further including:

means for retaining the walls in sealing engagement with the spacer ring.

16. The system as defined in claim 15, and further including:

a sealable fluid admitting orifice formed in the spacer ring.

* * * * *